United States Patent [19]

Leptien

[11] Patent Number: 4,859,159

[45] Date of Patent: Aug. 22, 1989

[54] SPIRAL COMPRESSOR WITH SETBACK PORTION ON RADIALLY OUTER PERIPHERAL WALL

[75] Inventor: Helmut Leptien, Wolfsburg, Fed. Rep. of Germany

[73] Assignee: Volkswagen AG, Wolfsburg, Fed. Rep. of Germany

[21] Appl. No.: 147,729

[22] Filed: Jan. 25, 1988

[30] Foreign Application Priority Data

Jan. 24, 1987 [DE] Fed. Rep. of Germany ..... 3702059

[51] Int. Cl.[4] ..... F04C 18/04

[52] U.S. Cl. ..... 418/55; 418/75

[58] Field of Search ..... 418/55, 59, 75, 77, 418/55 A, 55 B

[56] References Cited

U.S. PATENT DOCUMENTS

| | | | |
|---|---|---|---|
| 3,874,827 | 4/1975 | Young | 418/55 |
| 4,199,308 | 4/1980 | McCullough | 418/55 |
| 4,443,166 | 4/1984 | Ikegawa et al. | 418/75 |
| 4,490,099 | 12/1984 | Terauchi et al. | 418/55 |
| 4,514,150 | 4/1985 | Hiraga et al. | 418/55 |

FOREIGN PATENT DOCUMENTS

| | | | |
|---|---|---|---|
| 3107231 | 9/1982 | Fed. Rep. of Germany . | |
| 60-132085 | 7/1985 | Japan | 418/59 |

*Primary Examiner*—John J. Vrablik

*Attorney, Agent, or Firm*—Brumbaugh, Graves, Donohue & Raymond

[57] ABSTRACT

In the displacement machine for compressible media described in the specification, a stationary housing has two spiral displacement chambers and a spiral displacement body is engaged in each displacement chamber. The displacement body extends essentially perpendicularly to a disc-shaped rotor which can be driven eccentrically relative to the housing. In order to avoid butting of the displacement bodies against the walls of the displacement chambers resulting from different heat expansions of the rotor and the housing while maintaining a relatively small clearance between the peripheral contours of the displacement bodies and the peripheral walls of the displacement chambers, the radially outer peripheral walls of the displacement chambers have recesses in their upper edges which extend in the peripheral direction. The height of the recesses is approximately one quarter of the chamber height and the maximum depth of the recesses is approximately 0.15 mm.

4 Claims, 1 Drawing Sheet

SPIRAL COMPRESSOR WITH SETBACK PORTION ON RADIALLY OUTER PERIPHERAL WALL

BACKGROUND OF THE INVENTION

This invention relates to displacement machines for compressible media and, more particularly, to a new and improved displacement machine having a more effective and reliable structural arrangement.

Displacement machines for compressible media having a spiral displacement chamber formed by a housing having a base with an upstanding spiral wall and a rotor formed with another upstanding wall which can be driven eccentrically to the housing are known in principle, for example, from DE-OS No. 31 07 231. Such machines provide for nearly pulsation-free flow of a gaseous working medium such as air or an air/fuel mixture and they can therefore be utilized to advantage, among other things, to supply such mixtures to internal combustion engines, in particular in passenger automobiles. When such displacement machines are operated as a pump or a compressor, a plurality of approximately sickle-shaped working spaces are generally enclosed between the spiral walls of the housing and the rotor. These working spaces extend from a working medium inlet through the displacement chamber to a working medium discharge. During movement of the rotor, the volume of the working spaces can also be continuously reduces so that the pressure of the working medium is correspondingly increased.

The displacement bodies are formed by spiral-shaped ridges which are disposed essentially perpendicularly on the base of the disc-shaped rotor and they are relatively long in the direction away from the base in relation to their thickness. The housing has a similar arrangement between the displacement chambers, where the chamber walls comprise ridges upstanding which are spiral-shaped and are relatively long in the direction away from the base in relation to the wall thickness. During operation of the displacement machine, these relatively narrow ridges providing the displacement chamber walls come nearly in contact with the base portions of the housing and the rotor so that the sickle-shaped working spaces formed between the ridges are sealed relative to one another. The closer the ridges come to the base portions, the better is the sealing of the working spaces relative to one another and thus the output of the displacement machine is increased. On the other hand, a butting or direct contact between the components is to be avoided as much as possible because of the danger of damage. Therefore, the housings and rotors of displacement machines operating according to the spiral principle must be produced with very high precision and with narrow recesses between the peripheral contours of the displacement bodies and the displacement chamber walls.

It has been found, however, that even if high precision and narrow tolerances are adhered to during manufacture with a view to providing such small recesses between the displacement bodies and the displacement chamber walls, butting or direct contact problems may occur between the housing and the rotor because of different thermal expansion of the components. It is known that the foot regions of the radially outer peripheral walls of the displacement bodies tend to butt against the inner contours of the radially outer walls of the associated displacement chambers of the housing.

This occurs primarily because the rotor carrying the ridges which provide the displacement bodies is evidently heated to a higher temperature than the housing during operation and, as a result, the rotor walls expand more than the walls of the housing forming the displacement chambers. Specifically, butting of the radially outer displacement bodies against the inward walls of the displacement chambers was found in certain peripheral regions of the machine which were located approximately in the mid-angle region between a center line connecting the centers of the housing and of the bearing bore fixed in the housing for eccentric bearing of the rotor and a line extending perpendicularly thereto through the housing center. Although a general increase in the clearance between the peripheral contours of the displacement bodies and the displacement chamber walls would reduce the danger of butting or contact, it would also cause substantial output losses of the displacement machine due to increased leakage.

SUMMARY OF THE INVENTION

Therefore, it is the purpose of the invention to provide a displacement machine arranged to prevent butting of the displacement bodies against the peripheral walls of the displacement chambers which, on the one hand, does not cause any essential loss of performance and, on the other hand, can be produced in a simple manner.

This and other objects of the invention are attained by relieving the outer contours of the radially outer peripheral walls of the displacement chambers, for example, by providing set-back portions at the upper edges of those walls. These set-back portions, which may be formed as recesses in the walls, need to be provided only in those regions in which a butting or sliding contact may be expected. In contrast to the increased leakage losses and corresponding loss in output resulting from a general increase in the radical clearance between the peripheral contours of the displacement bodies and the displacement chamber walls, the arrangement of the present invention, wherein portions of the peripheral walls of the displacement chambers are set back, avoids the butting or contact problems without any significant increase in leakage losses. Preferably, the set-back portions or recesses are provided only in the radially outer regions of the radially outer peripheral walls and are thus provided only in a portion which is at most approximately one quarter of the total axial chamber height. In the other regions of the walls, the relatively narrow clearances between the peripheral contours of the displacement bodies and displacement chamber walls can be maintained.

In contrast to other possible arrangements which provide undercuts in the foot regions of the displacement bodies that are subject to contact with the housing, manufacture of displacement bodies in accordance with the present invention is substantially simpler in that the set-back portions or recesses on the peripheral walls of the displacement chambers are provided only in the upper edge portions of the walls. Moreover, there is no danger of weakening of the walls.

BRIEF DESCRIPTION OF THE DRAWINGS

Further objects and advantages of the invention will be apparent from a reading of the following description in conjunction with the accompanying drawings in which.

DESCRIPTION OF PREFERRED EMBODIMENT

Figure 1:
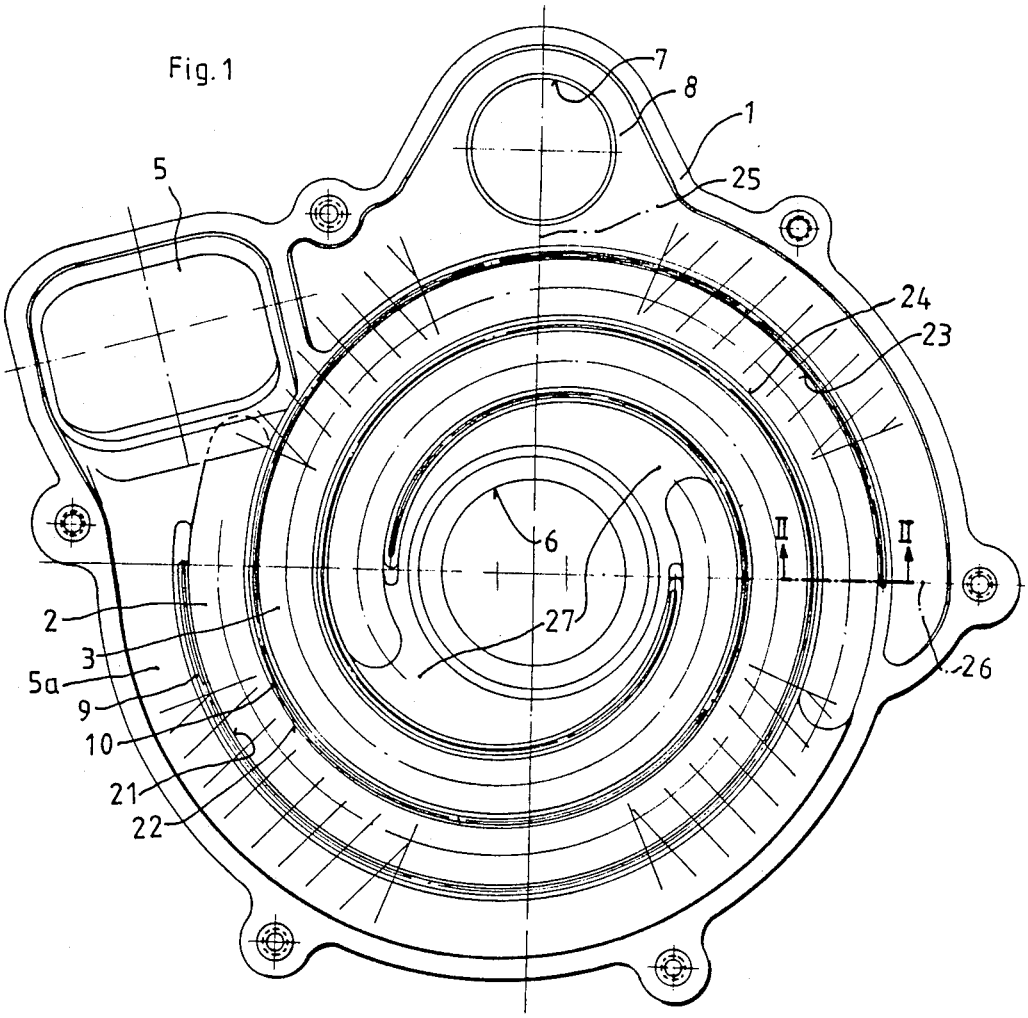
FIG. 1 is a plan view showing one half of the housing of a representative displacement machine arranged according to the invention.

In the housing portion 1 of the typical displacement machine according to the invention shown in FIG. 1, two displacement chambers 2 and 3 extend in a spiral shape and have their ends offset relative to each other by approximately 180°. In the illustrated embodiment, the contours of the peripheral wall surfaces 21, 22, 23 and 24 do not constitute true spirals but, instead, are a succession of arcs of circles with diminishing radii. The total circumferential angle of each of these spiral displacement chambers may measure approximately 360°.

Between the two displacement chambers 2 and 3 are two relatively small, ridge-like housing walls 9 and 10 which extend in a spiral shape and have a radial thickness which is relatively small in relation to their height and their circumferential length. The displacement chambers 2 and 3 communicate at their radially outer ends with an intake opening 5, the first displacement chamber 2 having its outer end at the intake opening 5 and the second displacement chamber 3 having its outer end connected to the intake opening 5 through a connecting conduit 5*a* formed in the peripheral region of the housing 1. The radially inner ends of the displacement chambers open into a region 27 which is connected to a discharge outlet in the second housing portion, not shown in the drawings. The working medium, which preferably is a gas, for example, air, or an air/fuel mixture, is conveyed during operation of the displacement machine from the intake opening 5 in the circumferential direction through the displacement chambers 2 and 3 into the region 27 from where it may be discharged from the machine by way of the discharge outlet.

Figure 2:
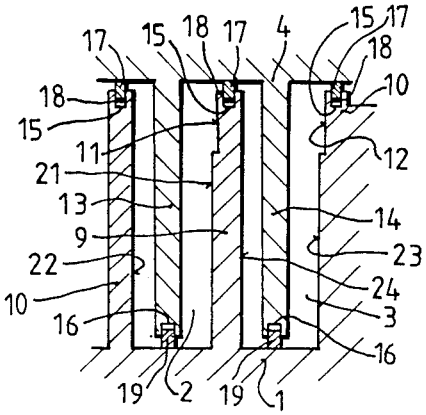
FIG. 2 is a fragmentary schematic representation showing a partial sectional view through the displacement machine of FIG. 1, taken along the sectional lines II—II in FIG. 1.

In the housing 1 there is a bearing bore 6 for the central drive shaft of a disc-shaped rotor which is supported eccentrically on the drive shaft. The disc-shaped rotor 4, partially illustrated in FIG. 2, has two displacement bodies 13 and 14 which project substantially perpendicularly from its base and extend into the displacement chambers 2 and 3. The displacement bodies 13 and 14, like the housing walls 9 and 10, are formed from spiral ridges having thickness which is substantially smaller than their height and their length. FIG. 2 shows that the spiral displacement bodies 13 and 14, as well as the spiral housing walls 9 and 10, are formed with grooves 15 and 16, respectively, extending along their edges. Sealing strips 17 and 19 are mounted in the grooves 15 and 16, respectively, so that they may be pressed against the end faces of the housing 1 and the disc-shaped rotor 4 by elastically resilient elements 18, such as corrugated springs for example, mounted in the bottoms of the circumferential grooves. In the embodiment illustrated in the drawings, the elastically resilient elements are provided only in the grooves 15 of the housing walls 9 and 10, whereas only the one-piece sealing strips 19 are held in the grooves 16 of the displacement bodies 13 and 14.

The curvatures of the displacement bodies 13 and 14 and, correspondingly, of the peripheral wall surfaces 21–24 of the displacement chambers 2 and 3 are arranged so that the radially outer and inner peripheral walls of the displacement bodies nearly come in contact with the smallest possible clearances at a plurality of points with the peripheral walls of the displacement chambers. As a result, a plurality of sickle-shaped working spaces are provided within the displacement chambers between the displacement chamber walls and the displacement body. These working spaces extend from the start of the displacement chamber which communicates with the intake opening 5 to the end of the displacement chamber connected to the discharge opening during operation of the displacement machine. In the course of this operation, each point of the displacement body performs a circular displacement movement relative to the stationary housing as a result of the eccentric motion of the rotor 4.

In order to produce the eccentric drive of the rotor 4 relative to the housing 1, a second bearing bore 7 is formed in a bearing lug 8 fixed on the radially outer periphery of the housing 1 to provide a second eccentric drive for the rotor drive shaft. A connecting line 25 is shown in FIG. 1 between the center of this second bearing bore 7 and the center of the first bearing bore 6, and a transverse line 26 extends through the center of the first bearing bore 6, which constitutes the center of the housing 1, essentially perpendicularly to the line 25.

In order to make certain that the desired narrow clearances which are provided for output reasons between the circumferential contours of the spiral displacement bodies 13 and 14 and the displacement chamber walls 21–24 of the displacement chambers 2 and 3 do not cause the displacement bodies to butt against or slide on the displacement chamber walls, portions of those walls are set back, as by recesses in the form of cut-away portions 11 and 12 at the upper edges of the radially outer peripheral walls 21 and 23, respectively, as shown in FIG. 2. The recesses 11 and 12 may have a height of up to about one fourth of the total chamber height and their depth may be up to about 0.15 mm. In the housing shown in FIG. 1, the recesses extend along the radially outer peripheral walls of the displacement chambers 2 and 3 over an angular region of up to about 200° measured from the radially outer ends of the displacement chambers. On the radially inner peripheral walls and in the radially inner peripheral region of the outer walls of the displacement chambers 22 and 24, such recesses are unnecessary since a butting or sliding contact of the spiral displacement bodies 13 and 14 may not be expected.

Essentially, the butting occurs because during operation of the displacement machine, the disc-shaped rotor 4 is heated to a higher temperature than the housing and the housing walls. The displacement bodies 13 and 14 on the disc-shaped rotor 4 are also less thermally affected. Because its temperature is higher, the disc-shaped rotor 4 expands to a greater extent than the surrounding housing so that it engages the foot portions of the ridge-like displacement bodies 13 and 14. However, because the rotor is held through its eccentric guide mechanism between the bearing bores 6 and 7 and is fixed there, thermal expansion and butting of the foot regions of the ridge-like displacement bodies 13 and 14 occurs most of all in a mid-angle region between the center line 25 and the cross line 26 shown in FIG. 1, and also occurs essentially only in the radially outer regions of the displacement bodies.

Provision of the clearances 11 and 12 in the regions where butting of the radially outer peripheral walls of the displacement chambers may occur thus prevents the butting and thereby the danger of damage to the rotor and the housing. At the same time, the provision of such recesses only in certain positions permits a relatively small clearance between the peripheral contours of the displacement bodies and the displacement chamber walls to be maintained so that performance losses of the displacement machine are minimized. Also, the recesses 11 and 12 can be formed very easily on the upper edges of the housing walls 9 and 10.

As mentioned above, the recesses can have a constant depth over a peripheral region of up to 200° on the radially outer peripheral walls of the displacement chambers. However, it may also be sufficient to provide the recesses only in the regions in which butting must definitely be expected, namely, in the mid-angle regions between the center line 25 and the transverse line 26. These mid-regions are indicated in FIG. 1 by hatchings and they extend over an angle of about 30° to 45° with respect to the median angle.

In view of the fact that the complex peripheral shapes of the displacement bodies and the displacement chambers nowadays are produced by program-controlled machining devices, it would also be possible to adjust the contours of the recesses in the aforementioned peripheral regions both axially and radially to overcome the butting or sliding contact conditions which actually occur during operation and thereby to provide a continuous transition from the normal outer contour to the recesses in the aforementioned regions.

Inasmuch as the displacement chambers may be produced by processes other than metal-cutting processes, the outer contours of the radially outer peripheral walls of the displacement chambers may be initially formed with recesses in the regions indicated, i.e., the walls could be provided with a correspondingly asymmetrical shape to start with.

Although the invention has been described herein with reference to a specific embodiment, many modification and variations therein will readily occur to those skilled in the art. Accordingly, all such variations and modifications are intended to be included within the scope of the invention.

I claim:

1. A displacement machine for compressible media comprising a stationary housing formed with at least one displacement chamber having a generally spiral shape and having radially inner and outer peripheral walls with upper edges and at least one displacement body having a generally spiral shape associated with the displacement chamber and positioned therein, the displacement body being positioned essentially perpendicularly on a disc-shaped rotor which is mounted for eccentric motion relative to the housing, wherein a portion of the upper edge of the radially outer peripheral wall of a displacement chamber is set back over at least a part of its peripheral region extending from its radially outer end to form a recess therein extending in the angular direction, the height of the set-back portion being no more than about one-quarter of the wall height and the radial depth of the set-back portion being no more than about 0.15 mm, said recess being configured to avoid contact or butting relation with the adjacent displacement body while providing a minimum chamber volume for maximum efficiency and minimum leakage.

2. A displacement machine as claimed in claim 1 wherein the housing has at least two displacement chambers offset relative to each other by approximately 180° and the set-back portions each extend along the radially outer peripheral walls of the displacement chambers over a circumferential angle of up to approximately 200° starting from the radially outer ends of the displacement chambers.

3. A displacement machine as claimed in claim 1 wherein the housing has a first bearing bore in the center of the housing and a second bearing bore in a bearing lug arranged on a radially outer edge of the housing for eccentric guiding of the disc-shaped rotor and the set-back portions are provided on the radially outer peripheral walls of the displacement chambers at least in circumferential angle regions which, when viewed from the center of the first bearing bore, extend in a mid-angle region between a connecting line through the center of the second bearing bore and a line perpendicular thereto extending through the center of the first bearing bore.

4. A displacement machine as claimed in claim 3 wherein the circumferential angle region in each case extends approximately 45°.

* * * * *